US012372236B2

(12) United States Patent
Wang

(10) Patent No.: US 12,372,236 B2
(45) Date of Patent: Jul. 29, 2025

(54) PARTICLE HEATING LANDSCAPE FURNACE

(71) Applicant: Haohong Electric Technology (Hubei) Co., Ltd., Huanggang (CN)

(72) Inventor: Min Wang, Huanggang (CN)

(73) Assignee: Haohong Electric Technology (Hubei) Co., Ltd., Huanggang (CN)

( * ) Notice: Subject to any disclaimer, the term of this patent is extended or adjusted under 35 U.S.C. 154(b) by 777 days.

(21) Appl. No.: 17/706,121

(22) Filed: Mar. 28, 2022

(65) Prior Publication Data

US 2023/0243501 A1 Aug. 3, 2023

(30) Foreign Application Priority Data

Jan. 28, 2022 (CN) ..... 202220240624.0

(51) Int. Cl.
*F23M 11/02* (2006.01)
*F23B 50/00* (2006.01)
*F23K 3/06* (2006.01)

(52) U.S. Cl.
CPC ..... *F23M 11/02* (2013.01); *F23B 1/36* (2013.01); *F23K 3/06* (2013.01); *F23M 2900/11021* (2013.01)

(58) Field of Classification Search
CPC .... F23B 1/36; F23B 50/12; F23K 3/06; F24B 1/08
See application file for complete search history.

(56) References Cited

U.S. PATENT DOCUMENTS 4,421,040 A * 12/1983 Lindstrom ..... C10J 3/74 110/294
2022/0357040 A1* 11/2022 Simon ..... F24B 7/025
2023/0010058 A1* 1/2023 Traeger ..... F23H 13/02

FOREIGN PATENT DOCUMENTS

CN 106440798 A 2/2017
CN 108870379 A 11/2018
EP 3936764 A1 1/2022

OTHER PUBLICATIONS

Extended European Search Report issued in counterpart European Patent Application No. 22164930.4, dated Aug. 26, 2022.

* cited by examiner

*Primary Examiner* — David J Laux
(74) *Attorney, Agent, or Firm* — Westbridge IP LLC

(57) ABSTRACT

Disclosed is a particle heating landscape furnace, which includes a combustion device. The combustion device includes a vertically arranged cover pipe, a grid and a combustion assembly. The combustion assembly has a feed chamber, a flame outlet and a flame outlet opposite to the flame outlet. A feed chamber is arranged obliquely, the flame outlet and the discharge port are both connected with the feed chamber, and the cover pipe is arranged on a periphery of the flame outlet, the grid is arranged on an outer side of the discharge port.

8 Claims, 3 Drawing Sheets

PARTICLE HEATING LANDSCAPE FURNACE

CROSS-REFERENCE TO RELATED APPLICATIONS

This application claims priority to Chinese Patent Application 202220240624.0, filed on Jan. 28, 2022, the entire contents of which are incorporated herein by reference.

TECHNICAL FIELD

The present application relates to the heating technology field of heating equipment, in particular to a particle heating landscape furnace.

BACKGROUND

A furnace is a kind of equipment that uses firewood particles as combustion materials and provides indoor heating. Its heating power is far greater than that of various air conditioners, and it is especially suitable for use in rural and urban areas. In the market, due to the unreasonable structure, the furnace is arranged indoors, which is easy to cause safety problems such as fire.

SUMMARY

The main purpose of the present application is to provide a particle heating landscape furnace, which aims to solve the problem that the particle heating landscape furnace is easily damaged in the related art.

To realize the purpose above, the present application provides a particle heating landscape furnace, in particular the particle heating landscape furnace includes a combustion device, the combustion device includes a vertically arranged cover pipe, a grid and a combustion assembly, the combustion assembly has a feed chamber, a flame outlet and a discharge port opposite to the flame outlet, the feed chamber is arranged obliquely, and both the flame outlet and the discharge port are in communication with the feed chamber, the cover pipe is arranged on a periphery of the flame outlet, and the grid is arranged on an outer side of the discharge port.

Optionally, the combustion assembly includes a feed pipe and a flame outlet pipe connected to each other, the feed chamber is formed in the feed pipe, an end of the flame outlet pipe away from the feed pipe forms the flame outlet, and the flame outlet pipe is covered by the cover pipe.

Optionally, the combustion assembly further includes a connecting pipe, and a side wall of the connecting pipe is provided with an avoidance opening, and an upper side edge of the avoidance opening contacts a side wall of the feed pipe, the flame outlet pipe is arranged in the connecting pipe, and a lower end of the cover pipe is sealingly connected with the connecting pipe.

Optionally, a heat insulation ring is sleeved on the cover pipe, and the heat insulation ring is clamped at a connection between the cover pipe and the connecting pipe.

Optionally, an outer wall of the flame outlet pipe is provided with an arc-shaped connecting ear, the arc-shaped connecting ear is helically arranged, and an outer edge of the arc-shaped connecting ear is in contact with the connecting pipe.

Optionally, the combustion device further includes a discharge pipe, the discharge pipe is arranged horizontally, and one side of the discharge pipe is provided with a discharge port corresponding to the grid.

Optionally, the particle heating landscape furnace further includes a supporting device, the supporting device includes a supporting rod and a base, one end of the supporting rod is connected to the discharge pipe, and another end of the supporting rod is connected to the base.

Optionally, an end of the feed pipe away from the cover pipe is provided with a sealing cover.

Optionally, the combustion device further includes a connecting rod, one end of the connecting rod is connected to the feed pipe, and the other end of the connecting rod is connected to the cover pipe.

Optionally, the cover pipe is a glass tube.

In the technical solution of the present application, the fuel placed in the feed chamber is burned to make the burning flame come out of the flame outlet, and the cover pipe arranged on the periphery of the flame outlet effectively blocks the direct contact between the outside world and the flame, which effectively protects the user's safety in use. The vertically arranged cover pipe is conducive to guide the flame to go up in the vertical direction, and make the flame in the particle heating landscape furnace more beautiful, and the particle heating landscape furnace is placed indoors, which can not only be used for heating, but also can be used to decorate the indoor home environment. In addition, the inclined arrangement of the feed chamber is conducive to the concentration of fuel in the bottom of the feed chamber, which is convenient for the combustion of fuel, and the flame outlet and the discharge port being oppositely arranged is conducive to the entry of air, promote the combustion of the fuel placed in the feed chamber and the flame out from the flame outlet. At the same time, the discharge port is also conducive to the discharge of waste materials such as ashes after fuel combustion. The grid arranged on the outside of the flame outlet prevents the fuel from falling, and will not affect the discharge of ashes and air flow.

BRIEF DESCRIPTION OF THE DRAWINGS

In order to more clearly illustrate the embodiments of the present application or the technical solutions in the related art, the following will briefly introduce the drawings needed in the description of the embodiments or the related art. Obviously, the drawings in the following description are only some embodiments of the present application. For those of ordinary skill in the art, without creative labor, other drawings can also be obtained according to the structure shown in these drawings.

DETAILED DESCRIPTION OF THE EMBODIMENTS

Figure 1:
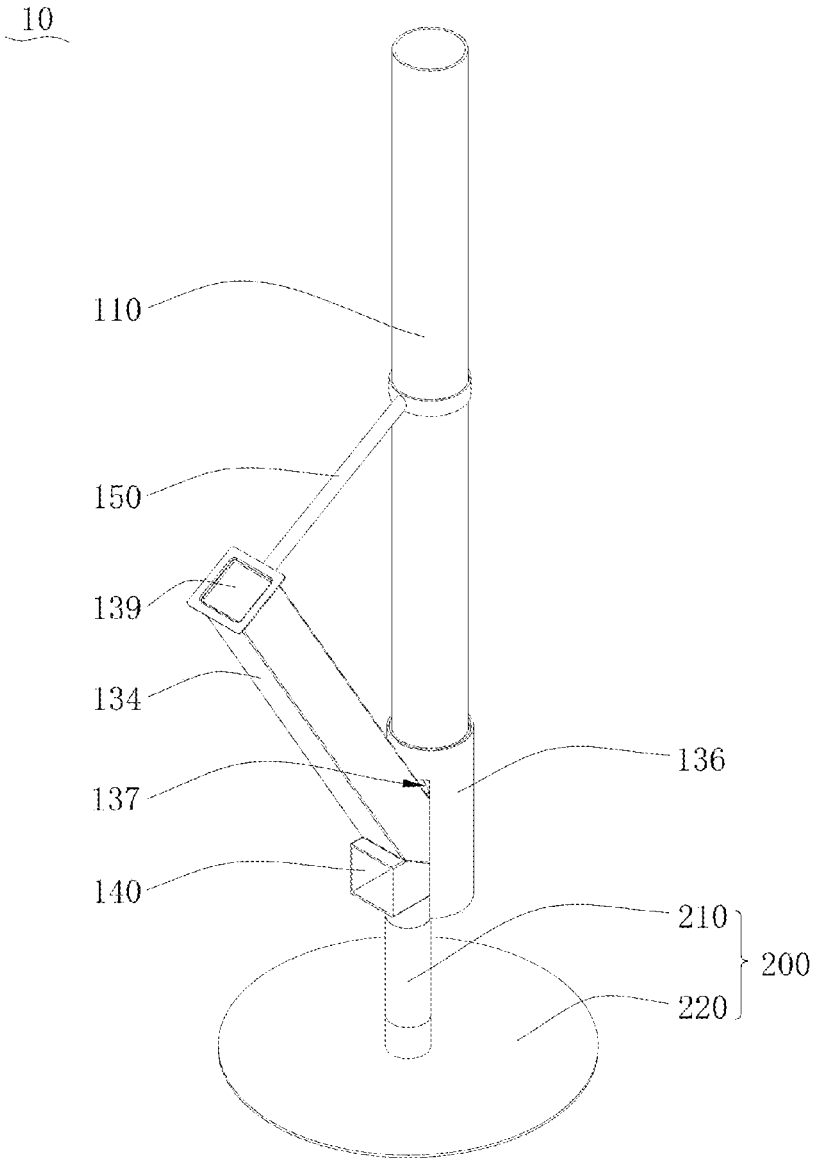
FIG. 1 is a structural view of a particle heating landscape furnace of an embodiment of the present application.

The technical solutions in the embodiments of the present application will be clearly and completely described below with reference to the accompanying drawings in the embodiments of the present application. Obviously, the described embodiments are only a part of the embodiments of the present application, not all of the embodiments. Based on the embodiment of the present application, all other embodiments obtained by ordinary skills in the art without making creative labor belong to the scope of protection of the present application.

It should be noted that all directional indications (such as up, down, left, right, front, rear, etc.) in the embodiments of the present application are only used to explain the relative positional relationship, movement situation, etc. between the components under a specific posture (as shown in the drawings), and if the specific posture changes, the directional indications also change accordingly.

In addition, the description of "first", "second" and the like in the present application is for descriptive purposes only and cannot be understood as indicating or implying the relative importance thereof or implying the number of technical features indicated. Therefore, a feature defined by "first" and "second" can explicitly or implicitly include at least one of the feature.

In addition, the technical solutions between the various embodiments of the present application can be combined with each other, but the combination must be based on the realization of ordinary skills in the related art. When the combination of the technical solutions is contradictory or cannot be realized, it should be considered that the combination of such technical solutions does not exist and is not within the scope of protection of the present application.

The present application provides a particle heating landscape furnace 10.

Figure 2:
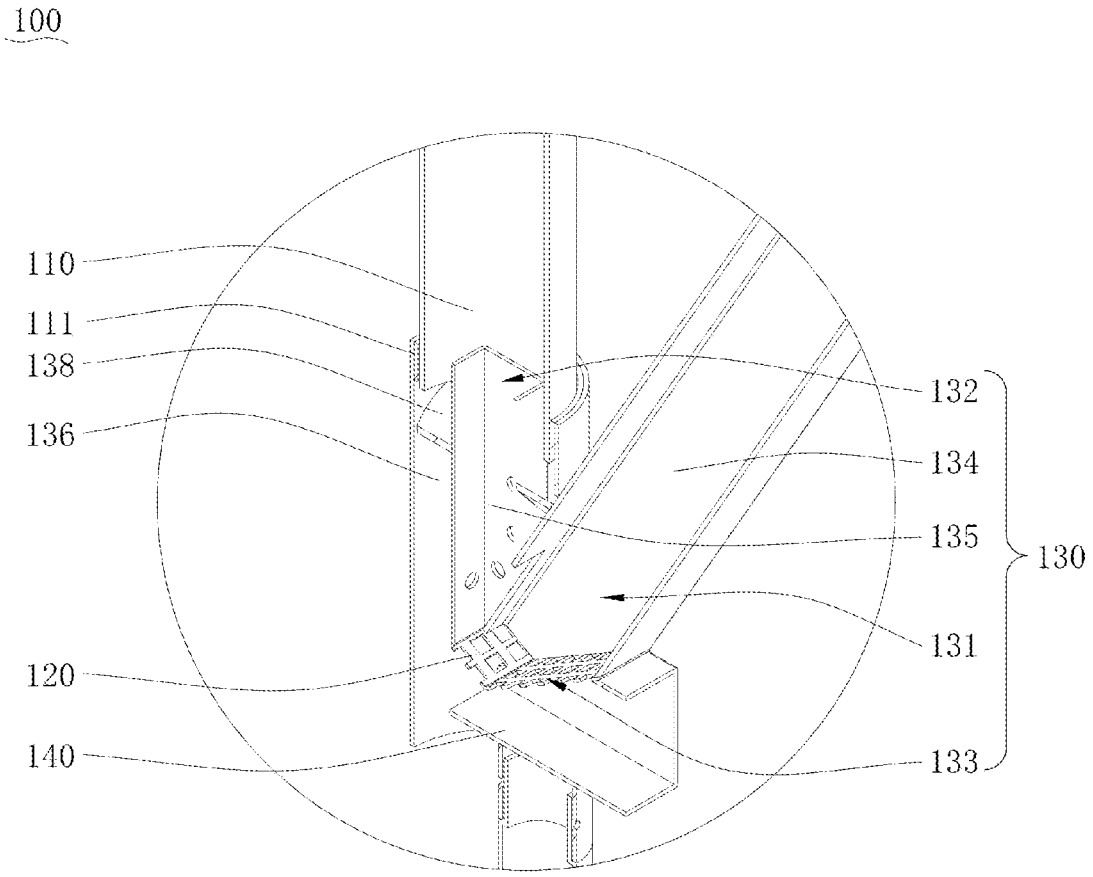
FIG. 2 is a cross-sectional view of a combustion device according to an embodiment of the present application.
Figure 3:
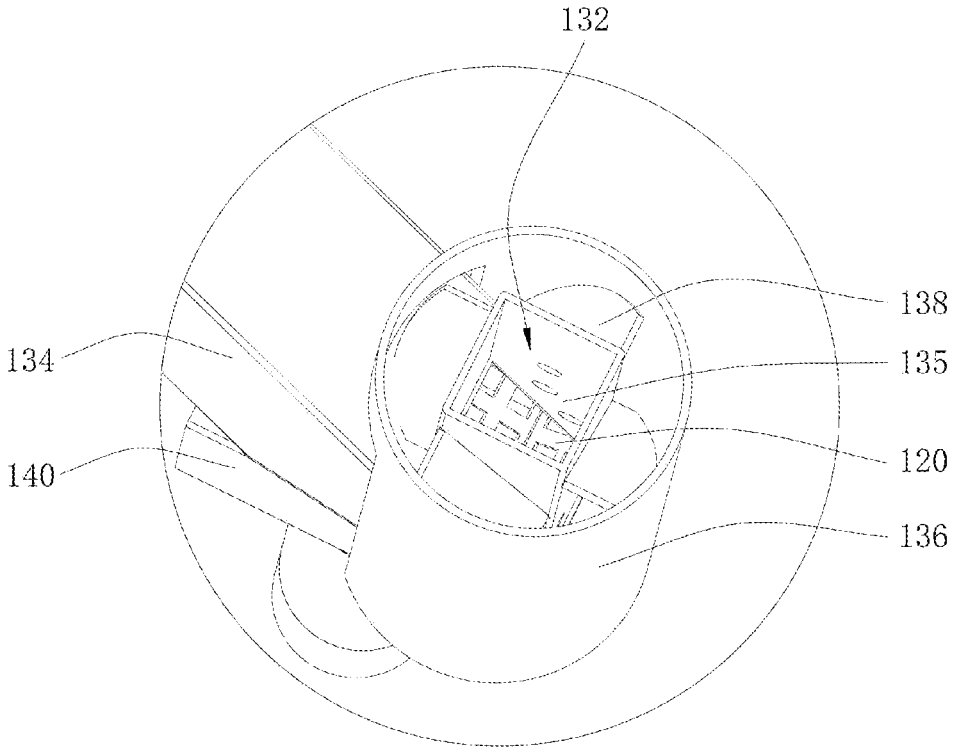
FIG. 3 is a schematic structural view of a flame exit port according to an embodiment of the present application.

As shown in FIGS. 1 and 2, in an embodiment, the particle heating landscape furnace 10 includes a combustion device 100. The combustion device 100 includes a vertically arranged cover pipe 110, a grid 120, and a combustion assembly 130. The combustion assembly 130 has a feed chamber 131 and a flame outlet 132 and a discharge port 133 arranged opposite to each other. The feed chamber 131 are arranged obliquely, the flame outlet 132 and the discharge port 133 are both communicated with the feed chamber 131, the cover pipe 110 is arranged on a periphery of the discharge port 132, and the grid 120 is arranged on the outside of the discharge port 133.

By burning the fuel placed in the feed chamber 131, the burning flame 132 is from the flame outlet, and the cover pipe 110 arranged on the periphery of the flame outlet 132 effectively blocks the direct contact between the outside world and the flame, effectively protecting safety of users, and the vertically arranged cover pipe 110 is conducive to guiding the flame to go up in a vertical direction. The flame in the particle heating landscape furnace 10 is more beautiful. Placing the particle heating landscape furnace 10 indoors can not only be useful for heating, but also be useful to decorate an indoor home environment. In addition, the feed chamber 131 is set inclined, which is beneficial to the fuel concentrated at a bottom of the feed chamber 131, and facilitates the combustion of the fuel. The flame outlet 132 and the discharge port 133 are arranged oppositely, which promotes the combustion of the fuel in the feed chamber 131. At the same time, the discharge port 133 is further conducive to the discharge of waste materials such as ashes after fuel combustion. The grid 120 arranged on an outside of the discharge port 133 prevents the fuel from falling, but does not affect the discharge of ashes and air flow.

In one embodiment, the cover pipe 110 is a glass tube. For the cover pipe 110 is a glass tube, a shape of the flame inside the particle heating landscape furnace 10 can be well seen because of the transparent nature of the glass tube, and, by selecting glass tubes of different colors, the flame is displayed through the glass tube in different colors, so that the flame generated by the particle heating landscape furnace 10 is more beautiful and different indoor atmospheres are created.

In an embodiment, the combustion assembly 130 includes a feed pipe 134 and a flame outlet pipe 135 which are in communication with each other, the feed pipe 134 forms the feed chamber 131, a section of the flame outlet pipe 135 away from the feed pipe 134 forms the flame outlet 132, and the cover pipe 110 is covered outside the flame outlet pipe 135. By setting the feed pipe 134, it is convenient to concentrate the fuel for combustion, to generate a higher flame and release more heat. The flame outlet pipe 135 makes the flame extend through the flame outlet pipe 135, so that the flame is more concentrated, and the more concentrated flame is more beautiful.

In an embodiment, the combustion assembly 130 further includes a connecting pipe 136, a side wall of the connecting pipe 136 is provided with an avoidance port 137, and an upper side edge of the avoidance port 137 contacts with a side wall of the feed pipe 134. The flame outlet pipe 135 is arranged in the connecting pipe 136. A lower end of the cover pipe 110 is sealingly connected with the connecting pipe 136. By setting the connecting pipe 136 and setting the flame outlet pipe 135 in the connecting pipe 136, the flame out from the flame outlet pipe 135 can be effectively protected. At the same time, the side wall of the connecting pipe 136 is opened with an avoidance port 137, and the upper side edge of the avoidance port 137 contacts with the side wall of the feed pipe 134. Since the feed pipe 134 is inclined, the lower end of the feed pipe 134 is located in the connecting pipe 136, the fuel is placed at the lower end of the feed chamber 131 in the feed pipe 134. The connecting pipe 136 can effectively protect the fuel in the feed chamber 131, avoiding damage to the fuel, the feed port, and the combustion port, and improving the service life of the particle heating landscape furnace 10, more specifically, an upper side of the connecting pipe 136 is welded together with the feed pipe 134, so that the connecting pipe 136 is installed more stably.

In an embodiment, a heat insulation ring 111 is sleeved on the cover pipe 110, and the heat insulation ring 111 is clamped at a connection between the cover pipe 110 and the connecting pipe 136. The heat insulation ring 111 is sleeved on the cover pipe 110, and the heat insulation ring is 111 clamped between the cover pipe 110 and the connecting pipe 136, which prevents the heat of the cover pipe 110 from being transferred to the connecting pipe 136, ensuring the user's safety. The heat insulation ring 111 can be made of flexible materials, which can also play a buffer and seal role.

In an embodiment, an outer wall of the flame outlet pipe 135 is provided with an arc-shaped connecting ear 138, the connecting ear 138 is helically arranged, and an outer edge of the connecting ear 138 abuts against the connecting pipe 136. Air can enter the cover pipe 110 through a gap between the connecting pipe 136 and the flame outlet pipe 135, and the arc-shaped connecting ear 138 is arranged on the outer wall of the flame outlet pipe 135, which can change the flow path of the air entering the cover pipe 110, so that the flame output at the flame outlet 132 is affected by a direction of the air to produce different shapes. Specifically, the connecting ear 138 is spirally arranged on the outer wall of the flame outlet pipe 135, and the angle between the connecting ear 138 and the horizontal direction is 30°, which is conducive to air entering from the lower end of the particle heating landscape furnace 10 and flowing through the connecting pipe 136. The connecting ear 138 arranged in the connecting pipe 136 changes the flow rate and direction of the air, so that the flame at the flame outlet 132 can be spiral, in addition, the connecting ear 138 of the spiral design further increases an air flow rate, increases the height of the flame at the flame outlet 132, and makes the flame generated by the particle heating landscape furnace 10 more beautiful. In other embodiments, the connecting ear 138 can be arranged on the outer wall of the flame outlet pipe 135 by other means such as being inclined arranged, vertically arranged, wave-shaped, or the like, so that the flame can achieve different effects, a specific setting mode can be changed according to actual needs, and the present application does not limit the way that the connecting ear 138 is arranged on the outer wall of the flame tube 135.

In an embodiment, a plurality of connecting ears 138 are provided, and the plurality of connecting ears are 138 spaced apart. By arranging a plurality of spiral arc-shaped connecting ears 138, the flame can be made spiral, and the particle heating landscape furnace 10 is more beautiful.

In an embodiment, the combustion device 100 further includes a discharge pipe 140, the discharge pipe 140 is arranged horizontally, and one side of the discharge pipe 140 is provided with a discharge port corresponding to the grid 120. The discharge pipe 140 set horizontally is provided with the discharge port corresponding to the grid 120, and wastes such as ashes leaking from the grid 120 are placed in the discharge pipe 140, which is convenient for collecting and processing the ashes and wastes after fuel combustion.

In an embodiment, the particle heating landscape furnace 10 further includes a supporting device 200, the supporting device 200 includes a supporting rod 210 and a base 220, one end of the supporting rod 210 is connected to the discharge pipe 140, and the other end of the supporting rod 210 is connected to the base 220. Further, the supporting device 200 includes the supporting rod 210 and the base 220, two ends of the supporting rod 210 are respectively connected to the base 220 and the discharge pipe 140, the providing of the supporting rod 210 and the base 220 is conducive to the stable installation of the particle heating landscape furnace 10, so that the particle heating landscape furnace 10 can be better placed.

In an embodiment, both ends of the supporting rod 210 are detachably connected with the base 220 and the discharge pipe 140. Through the detachable connection, the supporting device 200 is convenient for packaging and transportation. More specifically, the base 220 and the discharge pipe 140 are formed with a connecting ring on a side close to the supporting rod 210, both ends of the supporting rod 210 are provided with external threads, and an inner side of the connecting ring is provided with internal threads engageable with the external threads. By adjusting a connection position of the threads, the height of the supporting device 200 is adjusted, and then the height of the particle heating landscape furnace 10 is adjusted, so that the particle heating landscape furnace 10 can be applied to different scenarios, and the applicability of the particle heating landscape furnace 10 is improved.

In one embodiment, an end of the feed pipe 134 remote from the cover pipe 110 is provided with a sealing cover 139. By setting the sealing cover 139 covering the end of the feed pipe 134 away from the cover pipe 110, the air in the feed pipe 134 is prevented from forming convection, the flame is prevented from entering the end of the feed pipe 134 away from the flame outlet 132, improving the flame combustion effect at the flame outlet 132, and making the flame of the particle heating landscape furnace 10 more concentrated and more beautiful.

In an embodiment, the combustion device 100 further includes a connecting rod 150, one end of the connecting rod 150 is connected with the feed pipe 134, and the other end of the connecting rod 150 is connected with the cover pipe 110. Since the cover pipe 110 is set vertically and the feed pipe 134 is set obliquely, the cover pipe 110 and the feed pipe 134 are connected together by the connecting rod 150, the feed pipe 134 is fixed, so that the connection between the feed pipe 134 and the cover pipe 110 is more stable. More specifically, one end of the connecting rod 150 and the feed pipe 134 are detachably connected by bolts, and the other end of the connecting rod 150 is formed with an annular clamping sleeve, the connecting rod 150 is sleeved on the cover pipe 110 through the clamping sleeve. Preferably, the clamping sleeve can be a heat insulation ring.

The above is only an optional embodiment of the present application, and does not limit the scope of the present application. Any equivalent structural transformation made under the concept of the present application by using the description of the present application and the accompanying drawings, or any direct/indirect application in other related technical fields, is included in the protection scope of the present application.

What is claimed is:

1. A particle heating landscape furnace, wherein the particle heating landscape furnace comprises a combustion device, the combustion device comprises a vertically arranged cover pipe, a grid and a combustion assembly, the combustion assembly has a feed chamber, a flame outlet and a discharge port opposite to the flame outlet, the feed chamber is arranged obliquely, and both the flame outlet and the discharge port are in communication with the feed chamber, the cover pipe is arranged on a periphery of the flame outlet, and the grid is arranged on an outer side of the discharge port;

the combustion assembly comprises a feed pipe and a flame outlet pipe connected to each other, the feed chamber is formed in the feed pipe, an end of the flame outlet pipe away from the feed pipe forms the flame outlet, and the flame outlet pipe is covered by the cover pipe; and the combustion assembly further comprises a connecting pipe, and a side wall of the connecting pipe is provided with an avoidance opening, and an upper side edge of the avoidance opening contacts a side wall of the feed pipe, the flame outlet pipe is arranged in the connecting pipe, and a lower end of the cover pipe is sealingly connected with the connecting pipe.

2. The particle heating landscape furnace according to claim 1, wherein a heat insulation ring is sleeved on the cover pipe, and the heat insulation ring is clamped at a connection between the cover pipe and the connecting pipe.

3. The particle heating landscape furnace according to claim 2, wherein an outer wall of the flame outlet pipe is provided with an arc-shaped connecting ear, the arc-shaped connecting ear is helically arranged, and an outer edge of the arc-shaped connecting ear is in contact with the connecting pipe.

4. The particle heating landscape furnace according to claim 1, wherein the combustion device further comprises a discharge pipe, the discharge pipe is arranged horizontally, and one side of the discharge pipe is provided with a discharge port corresponding to the grid.

5. The particle heating landscape furnace according to claim 4, wherein the particle heating landscape furnace further comprises a supporting device, the supporting device comprises a supporting rod and a base, one end of the supporting rod is connected to the discharge pipe, and another end of the supporting rod is connected to the base.

6. The particle heating landscape furnace according to claim 1, wherein an end of the feed pipe away from the cover pipe is provided with a sealing cover.

7. The particle heating landscape furnace according to claim 1, wherein the combustion device further comprises a connecting rod, one end of the connecting rod is connected to the feed pipe, and the other end of the connecting rod is connected to the cover pipe.

8. The particle heating landscape furnace according to claim 1, wherein the cover pipe is a glass tube.

* * * * *